US009355791B2

(12) United States Patent
Poisson

(10) Patent No.: US 9,355,791 B2
(45) Date of Patent: May 31, 2016

(54) DISCRETE INPUT CIRCUIT

(71) Applicant: Richard A. Poisson, Avon, CT (US)

(72) Inventor: Richard A. Poisson, Avon, CT (US)

(73) Assignee: HAMILTON SUNDSTRAND CORPORATION, Windsor Locks, CT (US)

( * ) Notice: Subject to any disclaimer, the term of this patent is extended or adjusted under 35 U.S.C. 154(b) by 627 days.

(21) Appl. No.: 13/680,515

(22) Filed: Nov. 19, 2012

(65) Prior Publication Data

US 2014/0139015 A1 May 22, 2014

(51) Int. Cl.
*H01H 1/60* (2006.01)

(52) U.S. Cl.
CPC ..... *H01H 1/60* (2013.01); *H01H 1/605* (2013.01); *Y10T 307/74* (2015.04)

(58) Field of Classification Search
CPC ..... H01H 1/60; H01H 1/605; H02J 13/00; Y10T 307/74
See application file for complete search history.

(56) References Cited

U.S. PATENT DOCUMENTS 4,550,356 A * 10/1985 Takahashi ..... H01H 33/161 361/11
4,851,707 A 7/1989 Lindsay
5,239,520 A * 8/1993 Arnold ..... 368/10
6,600,242 B1 * 7/2003 Dennison ..... 307/125
6,800,965 B1 * 10/2004 Turner et al. ..... 307/128
2010/0283512 A1 * 11/2010 Acharya ..... H02J 13/002 327/101

FOREIGN PATENT DOCUMENTS

JP H0433220 A 2/1992
JP H09306269 A 11/1997

OTHER PUBLICATIONS

Schubert R., Sealing Current and Regeneration of Copper Junctions, Mar. 1991, IEEE Transactions on COmponents, Hybrids and Manufacturing Technology, vol. 14, No. 1, Mar. 1991, pp. 214-217.*
RC circuit, on-line encyclopedia Wikipedia, http://en.wikipedia.org/wiki/RC_circuit, pp. 1-9.*
Motorola; "Multiple Switch Detection Interface"; Motorola, Inc.; Freescale Semiconductor, Inc.; Document Order No. MC33993/D; Rev 3.0; p. 1-28; 2003.
Motorola; "Multiple Switch Detection Interface With Suppressed Wake-Up"; Motorola, Inc.; Freescale Semiconductor, Inc.; Document Order No. MC33972/D; Rev 2.0; p. 1-28; 2003.
GB Search Report for Application No. GB1320278.3. Mailed on Aug. 6, 2014 3 pages.

* cited by examiner

*Primary Examiner* — Zeev V Kitov
(74) *Attorney, Agent, or Firm* — Cantor Colburn LLP

(57) ABSTRACT

Embodiments are directed to a discrete input circuit comprising: a switch, a capacitor coupled to the switch, a first resistor connected in series with the capacitor and coupled to a power supply, and a second resistor coupled to the power supply and the switch, wherein a value of the capacitor, a value of the first resistor, and a value of the second resistor are selected to provide a wetting current from the power supply to the switch when the switch is closed in order to clean contacts associated with the switch.

10 Claims, 3 Drawing Sheets

DISCRETE INPUT CIRCUIT

BACKGROUND

Discrete circuits (or "discretes") may be used to convey a particular command or status information regarding equipment, components, or devices aboard an aircraft. For example, a landing gear discrete may be used by a fuel controller aboard the aircraft as a basis for determining whether to transfer fuel from a first fuel tank (e.g., a fuel tank located in a fuselage) to a second fuel tank (e.g., a fuel tank located in or near a wing of the aircraft).

A wetting current may be used to clean contacts of a switch included in a discrete in order to maintain and ensure quality connections when, e.g., the switch is closed and current passes through a discrete input circuit. Discrete input circuits may require large wetting currents. For example, an engine control discrete input may require wetting currents on the order of ten milliamps (10 mA) to forty milliamps (40 mA) per discrete. Using conventional techniques, the large wetting currents may require large components to be used in order to safely dissipate the power associated with the current. Aircraft reliability analyses may require even larger components to be used if additional de-rating (e.g., component power dissipation de-rating) is required.

BRIEF SUMMARY

Embodiments are directed to a discrete input circuit comprising: a switch, a capacitor coupled to the switch, a first resistor connected in series with the capacitor and coupled to a power supply, and a second resistor coupled to the power supply and the switch, wherein a value of the capacitor, a value of the first resistor, and a value of the second resistor are selected to provide a wetting current from the power supply to the switch when the switch is closed in order to clean contacts associated with the switch.

Embodiments are directed to a method comprising: selecting a first level for a current that is associated with a switch and is used to clean contacts associated with the switch when the switch is closed, selecting a second level for the current, selecting a time decay profile between the first level and the second level, selecting a value for a capacitor, a value for a first resistor, and a value for a second resistor based on the first level, the second level, and the time decay profile, and constructing a circuit using the capacitor, the first resistor, and the second resistor.

Additional embodiments are described below.

BRIEF DESCRIPTION OF THE DRAWINGS

The present disclosure is illustrated by way of example and not limited in the accompanying figures, in which.

DETAILED DESCRIPTION

Figure 1:
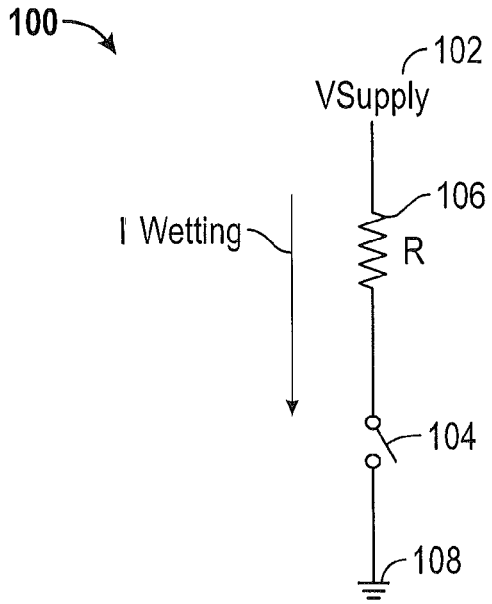
FIG. 1 (Prior Art)
FIG. 1 illustrates a circuit in accordance with the prior art.

It is noted that various connections are set forth between elements in the following description and in the drawings (the contents of which are included in this disclosure by way of reference). It is noted that these connections in general and, unless specified otherwise, may be direct or indirect and that this specification is not intended to be limiting in this respect. In this regard, a coupling of entities, components, and/or devices may refer to either a direct connection or an indirect connection.

In accordance with various aspects of the disclosure, component sizes used in connection with a circuit (e.g., a discrete input circuit) may be reduced or minimized relative to a conventional circuit. In some embodiments, power dissipation in connection with a circuit may be reduced or minimized relative to a conventional circuit. In some embodiments, a power supply may be associated with a reduced or lower current relative to a power supply that may be used in a conventional circuit.

FIG. 1 illustrates a discrete input circuit 100 in accordance with the prior art. As shown in FIG. 1, the circuit 100 may include a power supply (VSupply) 102. The power supply 102 may be associated with a constant voltage, such as 28 VDC.

The power supply 102 may be coupled to a switch 104 via a resistor (R) 106. The switch 104 may be coupled to a reference node, such as a ground 108. When the switch 104 is open, no current flows through the switch 104. When the switch 104 is closed, a current (Iwetting) flows from the power supply 102 to the ground 108 via the resistor 106 and the switch 104.

The resistor 106 may be selected to ensure at least a minimum current Iwetting when the switch 104 is closed. The current Iwetting may be used to break through a film of oxidation that may have been deposited on contacts of the switch 104. As known to one of skill in the art, the film of oxidation may be caused by one or more environmental factors, such as employment of the circuit 100 in an environment characterized by elevated humidity.

Figure 2:
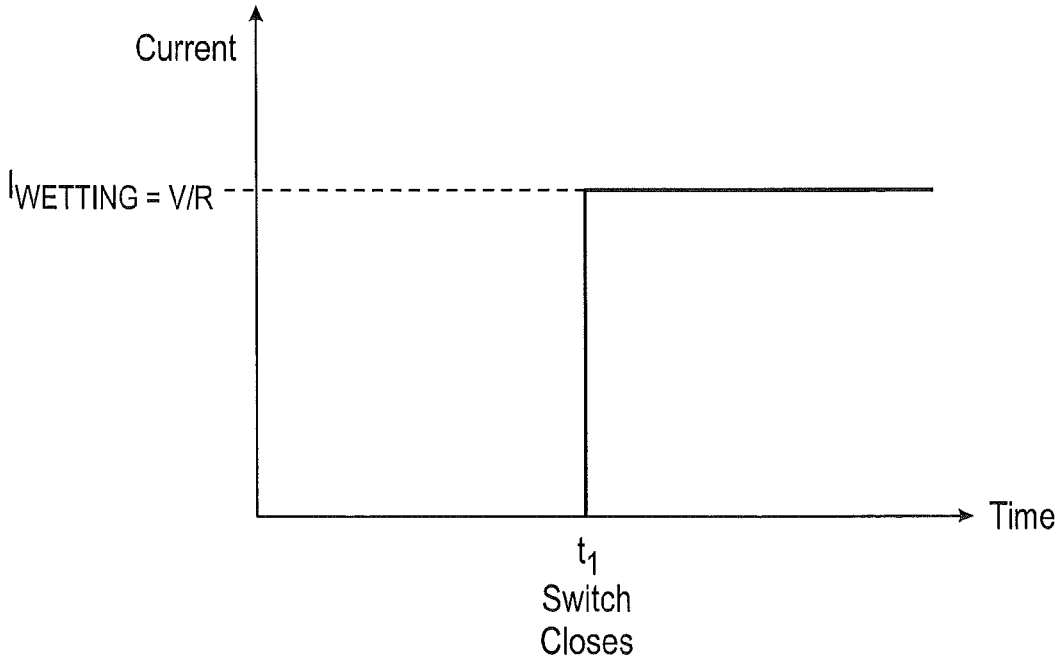
FIG. 2 (Prior Art)
FIG. 2 illustrates a distribution of current in accordance with the prior art.

A profile or distribution of the current flowing through the resistor 106 and the switch 104 as a function of time is shown in FIG. 2. Prior to a time $t_1$ the switch 104 is open. As a result of the switch 104 being open, no current flows through the resistor 106 and the switch 104. At the time $t_1$ the switch 104 is closed. After the time $t_1$ the current (Iwetting) is equal to the voltage (V) supplied by the power supply 102 divided by the value of the resistor (R) 106, excluding any "on" resistance associated with the switch 104 (or including such "on" resistance in the model of the resistor 106). The current Iwetting may be present for every active discrete, resulting in a summation or multiplication of the current Iwetting for a total current draw.

When the switch 104 is closed, the power dissipation (P) in the resistor (R) 106 is equal to the current (Iwetting) squared multiplied by the value of the resistor 106 (e.g., P=Iwetting^2*R). Accordingly, large component types or values may need to be used. For example, the resistor 106 may need to be of a large physical size to safely handle the power that is dissipated therein. Similarly, the power supply 102 may need to be of a large size or form factor in order to source sufficient power.

The cleaning effect provided by the wetting current Iwetting with respect to the contacts of the switch 104 might only be operative for a short amount of time (e.g., the first few milliseconds following the closure of the switch 104 at the time $t_1$). Continued current flow in the amount of Iwetting as shown in FIG. 2 might not aid the cleaning of the contacts.

In recognition of the relatively short time span during which the cleaning of the contacts occurs, a circuit as disclosed herein may be designed and implemented to reduce the amount of current flow over time when the switch 104 is closed. Such a circuit 300 is shown in FIG. 3.

Figure 3:
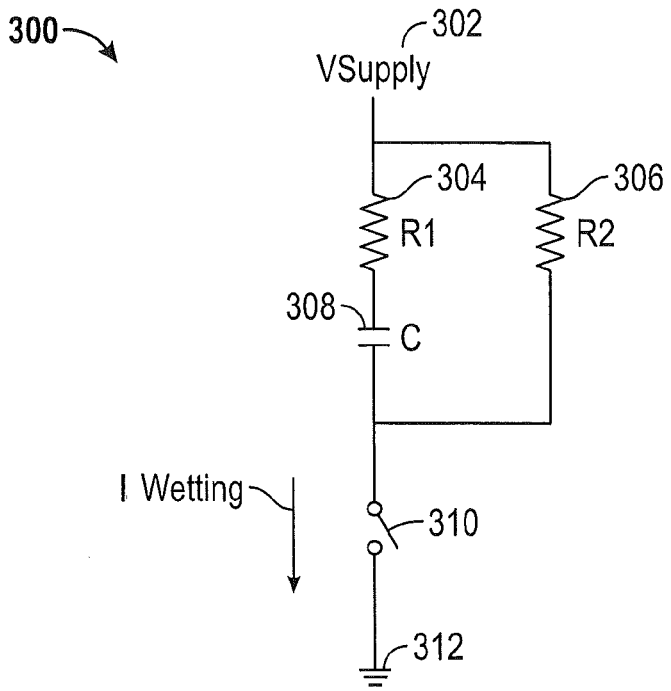
FIG. 3 illustrates an exemplary circuit in accordance with one or more aspects of this disclosure.

As shown in FIG. 3, the circuit 300 according to one embodiment may include a power supply (VSupply) 302. In some embodiments, the power supply 302 may correspond to the power supply 102 of FIG. 1. In some embodiments, the power supply 302 may provide a constant voltage.

The power supply 302 may be coupled to a resistor (R1) 304 and a resistor (R2) 306. The resistor 304 may be coupled to a capacitor (C) 308. For example, the resistor 304 and the capacitor 308 may be connected in series. The resistor 306 may be connected in parallel to the series combination of the resistor 304 and the capacitor 308. The capacitor 308 and the resistor 306 may be coupled to a switch 310. The switch 310 may be coupled to a ground 312. In some embodiments, the switch 310 may correspond to the switch 104 of FIG. 1.

The components and devices shown in connection with FIG. 3 are illustrative. In some embodiments, one or more of the components may be optional. In some embodiments, the components may be arranged in a manner that is different from what is shown in FIG. 3. In some embodiments, one or more additional components not shown may be included.

Figure 4:
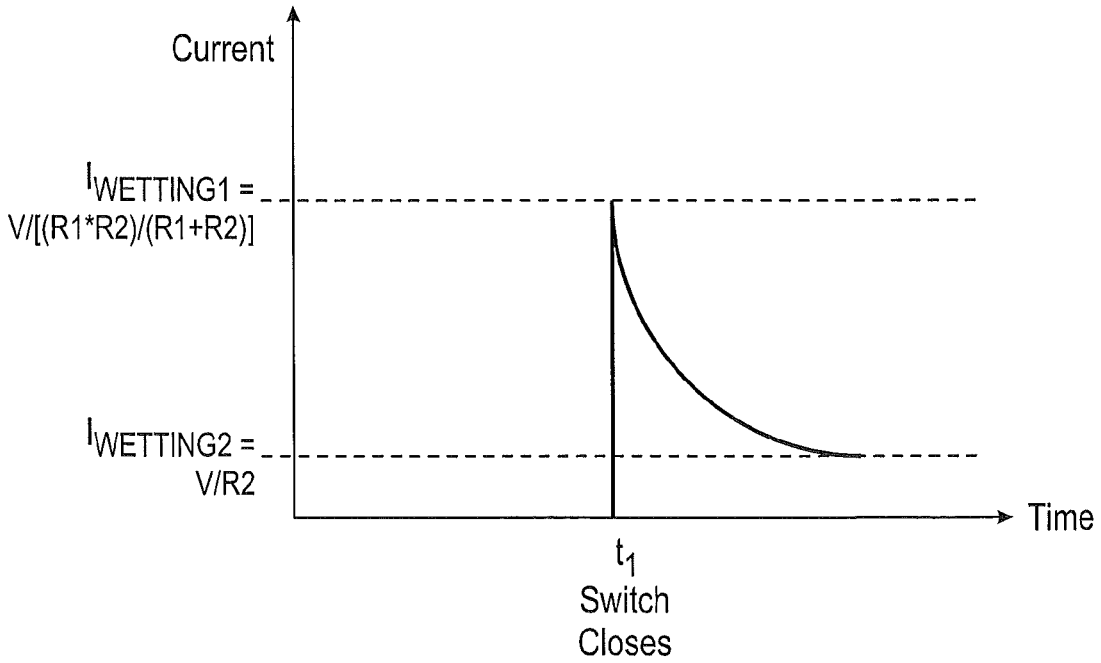
FIG. 4 illustrates an exemplary distribution of current in accordance with one or more aspects of this disclosure.

A profile or distribution of the current flowing through the switch 310 as a function of time is shown in FIG. 4. Prior to a time $t_1$ the switch 310 may be open. As a result of the switch 310 being open, no current flows through the switch 310. At the time $t_1$ the switch 310 is closed, and the current ($Iwetting_1$) through the switch 310 is equal to the voltage (V) supplied by the power supply 302 divided by the effective value (Reff) of the resistors 304 and 306, or $Iwetting_1$=V/Reff. The effective value (Reff) of the resistors (R1) 304 and (R2) 306 may be given by their parallel combination: (R1*R2)/(R1+R2).

After the time $t_1$, the flow of current provided by the power supply 302 causes the capacitor 308 to charge to approximately the voltage (V) supplied by the power supply 302. The charging of the capacitor 308 may reduce the voltage across the resistor 304, which in turn may reduce the amount of current flowing through the resistor 304. Over time, the current flowing through the switch 310 may approach an asymptote ($Iwetting_2$) given by: $Iwetting_2$=V/R2.

As shown via the profile or distribution of the current in FIG. 4, one can see that a relatively large current ($Iwetting_1$) may initially flow through the switch 310 at the time $t_1$ when the switch 310 is initially closed. The actual value of this large current may (largely) be a result of the values of resistor 304 and the capacitor 308. As time progresses following the closure of the switch 310 at the time $t_1$ the current through the switch 310 decays to a lower value ($Iwetting_2$) whose value is established primarily by the value of the resistor 306. Thus, the circuit 300 may provide for a relatively large initial current to clean the contacts of the switch 310, followed by a relatively small current to minimize the power supplied by the power supply 302. Part of the wetting current may be stored in the capacitor 308, reducing a surge current the power supply 302 has to provide.

The current through the switch 310 may be based on the value of the voltage (V) supplied by the power supply 302, the values of the resistors 304 and 306, and the value of the capacitor 308. The values may be selected to obtain a particular profile (e.g., decay profile) or distribution for the current.

Figure 5:
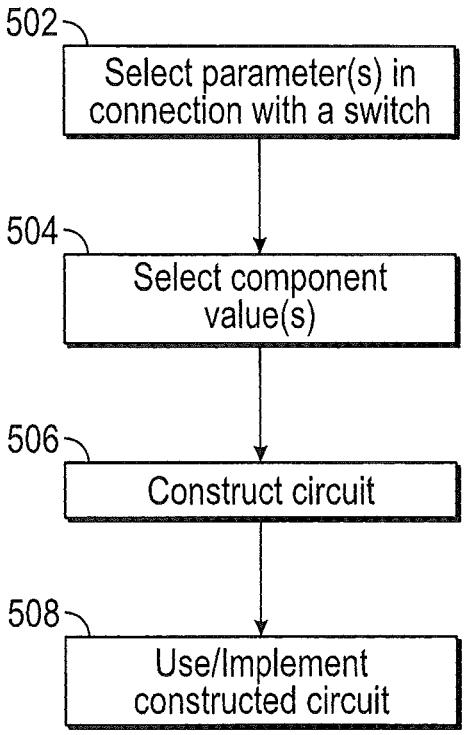
FIG. 5 illustrates a method in accordance with one or more aspects of this disclosure.

FIG. 5 illustrates a method in accordance with one or more embodiments of the disclosure. The method of FIG. 5 may be operative in connection with one or more components or devices, such as those described herein. For the sake of convenience and illustrative simplicity, the method of FIG. 5 is described below in connection with the circuit 300 and the current profile/distribution shown in FIG. 4. In some embodiments, the method of FIG. 5 may be executed by a computing device comprising a processor.

In block 502, one or more parameters may be selected in connection with a switch (e.g., the switch 310). For example, values or levels for $Iwetting_1$ and $Iwetting_2$ and a delay profile (e.g., a time-based decay profile) between the values $Iwetting_1$ and $Iwetting_2$ may be selected based on: a voltage (V) provided by a power supply (e.g., the power supply 302), one or more properties associated with the switch, environmental conditions where the switch operates, etc. In some embodiments, the delay or decay profile may be continuous in nature (e.g., might not incur a step down relative to a maximum current).

In block 504, one or more component values may be selected. For example, component values for one or more resistors (e.g., the resistors 304 and 306) and one or more capacitors (e.g., the capacitor 308) may be selected based on the parameters of the block 502.

In block 506, a circuit (e.g., the circuit 300) may be constructed using the component values selected in the block 504.

In block 508, the circuit constructed in block 506 may be used or implemented. The circuit may be used as a discrete input circuit, optionally in connection with operation of an aircraft. The circuit may be used to indicate or convey a status associated with the operation of one or more devices or pieces of equipment, such as an engine controller.

The blocks or operations associated with the method of FIG. 5 are illustrative. In some embodiments, one or more operations (or a portion thereof) may be optional. In some embodiments, the operations may execute in an order or sequence different from what is shown in FIG. 5. In some embodiments, one or more additional operations not shown may be included.

Embodiments of the disclosure may be tied to particular machines. For example, in some embodiments one or more circuits or components may be used to provide a relatively large amount of current initially to a switch to clean contacts associated with the switch. Thereafter, the circuit or components may reduce the provided current in order to reduce an amount of power supplied by a power source.

While illustrative examples are described herein in connection with aircraft applications, aspects of the disclosure may be implemented in connection with different or alternative embodiments. For example, aspects of the disclosure may be implemented in connection with marine applications, automotive applications, and the like.

In some embodiments various functions or acts may take place at a given location and/or in connection with the operation of one or more apparatuses or systems. In some embodiments, a portion of a given function or act may be performed at a first device or location, and the remainder of the function or act may be performed at one or more additional devices or locations. Embodiments of the disclosure may be directed to one or more systems, apparatuses, and/or methods.

Embodiments of the disclosure may be implemented using hardware, software, firmware, or any combination thereof. In some embodiments, various mechanical components known to those of skill in the art may be utilized.

Aspects of the disclosure have been described in terms of illustrative embodiments thereof. Numerous other embodiments, modifications and variations within the scope and spirit of the appended claims will occur to persons of ordinary skill in the art from a review of this disclosure. For example, one of ordinary skill in the art will appreciate that the steps described in conjunction with the illustrative figures may be performed in other than the recited order, and that one or more steps illustrated may be optional in accordance with aspects of the disclosure.

What is claimed is:

1. A discrete input circuit comprising:

a switch;

a capacitor coupled to the switch;

a first resistor connected in series with the capacitor and coupled to a power supply; and a second resistor coupled to the power supply and the switch, the second resistor is connected in parallel with the first resistor and the capacitor, wherein a value of the capacitor and a value of the first resistor are selected to provide a wetting current from the power supply to the switch when the switch is closed in order to clean contacts associated with the switch, the switch is coupled to a ground.

2. The discrete input circuit of claim 1, wherein the second resistor is connected in parallel with the first resistor and the capacitor.

3. The discrete input circuit of claim 1, wherein the value of the capacitor and the value of the first resistor selected to provide a specified decay in the wetting current when the switch is closed.

4. The discrete input circuit of claim 1, wherein the discrete input circuit is located on an aircraft.

5. A method comprising:

selecting a first level for a current that is associated with a switch and is used to clean contacts associated with the switch when the switch is closed, the switch is coupled to a ground;

selecting a second level for the current;

selecting a time decay profile between the first level and the second level;

selecting a value for a capacitor, a value for a first resistor, and a value for a second resistor based on the first level, and the time decay profile; and constructing a circuit using the capacitor, the first resistor, and the second resistor, wherein constructing the circuit comprises connecting the first resistor in series with the capacitor and connecting the second resistor in parallel with the first resistor and the capacitor.

6. The method of claim 5, wherein constructing the circuit further comprises:

coupling the first resistor to a power supply; and coupling the switch to the capacitor and the second resistor.

7. The method of claim 6, further comprising:

connecting the first resistor to the power supply;

connecting the switch to the capacitor and the second resistor; and connecting the switch to the ground.

8. The method of claim 6, wherein the power supply is configured to provide a constant voltage, and wherein the selected value for the capacitor, the selected value for the first resistor, and the selected value for the second resistor are based on a value of the constant voltage and are selected to cause the current to flow through the switch in accordance with the first level, the second level, and the time decay profile.

9. The method of claim 5, further comprising:

using the circuit as a discrete input circuit in connection with an operation of an aircraft.

10. The method of claim 9, further comprising:

using the discrete input circuit to convey a status associated with an operation of an engine controller associated with the aircraft.

* * * * *